US012523140B2

(12) United States Patent
Fan et al.

(10) Patent No.: US 12,523,140 B2
(45) Date of Patent: Jan. 13, 2026

(54) SHOCK DAMPING RING DESIGN FOR DOWNHOLE ELECTRONIC SYSTEMS

(71) Applicant: Schlumberger Technology Corporation, Sugar Land, TX (US)

(72) Inventors: Xing Fan, Rosharon, TX (US); Marius Smarandache, Rosharon, TX (US); David Merlau, Rosharon, TX (US); Brian John Bethscheider, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/591,791

(22) Filed: Feb. 29, 2024

(65) Prior Publication Data

US 2025/0277439 A1 Sep. 4, 2025

(51) Int. Cl.
*E21B 47/017* (2012.01)
*E21B 49/08* (2006.01)

(52) U.S. Cl.
CPC ..... *E21B 47/017* (2020.05); *E21B 49/081* (2013.01)

(58) Field of Classification Search
CPC ..... E21B 47/01; E21B 47/017; F16F 7/02; F16F 7/04
USPC ..... 267/214, 215, 137, 141
See application file for complete search history.

(56) References Cited

U.S. PATENT DOCUMENTS 2,894,586 A * 7/1959 Schramm ..... E21B 23/02 166/125
3,494,417 A * 2/1970 Fredd ..... E21B 34/105 166/321
3,568,770 A * 3/1971 Fredd ..... E21B 23/08 166/217
4,715,445 A * 12/1987 Smith, Jr. ..... E21B 31/20 166/217
4,726,425 A * 2/1988 Smith, Jr. ..... E21B 43/10 166/387
5,058,671 A * 10/1991 Cochran ..... E21B 21/10 166/387
7,429,934 B2 * 9/2008 Sim ..... E21B 34/105 340/854.3

(Continued)

FOREIGN PATENT DOCUMENTS

CN 101563275 A * 10/2009 ..... E21B 17/006
CN 118257576 A * 6/2024
FR 2739744 A1 * 4/1997 ..... E21B 47/011

*Primary Examiner* — Jennifer H Gay
(74) *Attorney, Agent, or Firm* — Jeffrey D. Frantz

(57) ABSTRACT

The present disclosure presents a shock damping ring for use in a downhole tool that includes a base ring structure a plurality of fingers extending from the base ring structure axially parallel to a central axis of the base ring structure. Each finger of the plurality of fingers is configured to physically abut first and second tubular components of the downhole tool and to reduce shock amplification between the first and second tubular components of the downhole tool. In addition, at least one finger of the plurality of fingers includes a beveled, chamfered, or radiused surface configured to physically abut one tubular component of the first and second tubular components of the downhole tool, and an orthogonal surface configured to physically abut the other tubular component of the first and second tubular components of the downhole tool.

18 Claims, 12 Drawing Sheets

(56) References Cited

U.S. PATENT DOCUMENTS

| | | | | |
|---|---|---|---|---|
| 10,519,762 | B2 * | 12/2019 | Peter | E21B 47/017 |
| 10,808,788 | B2 * | 10/2020 | Seeley | F16F 7/04 |
| 2003/0043055 | A1 * | 3/2003 | Schultz | E21B 47/01 340/856.3 |
| 2006/0098532 | A1 * | 5/2006 | Sim | E21B 47/24 367/83 |
| 2012/0049425 | A1 * | 3/2012 | Willis | H05K 7/142 267/141 |
| 2017/0037697 | A1 * | 2/2017 | Kellogg | E21B 33/1285 |
| 2018/0291976 | A1 * | 10/2018 | Seeley | F02C 7/222 |
| 2019/0055832 | A1 * | 2/2019 | Peter | E21B 47/01 |
| 2021/0164315 | A1 * | 6/2021 | Fripp | E21B 33/1208 |

* cited by examiner

SHOCK DAMPING RING DESIGN FOR DOWNHOLE ELECTRONIC SYSTEMS

BACKGROUND

The present disclosure relates generally to a shock damping ring design for use in downhole tools to protect electronic systems of the downhole tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Downhole tools in the oilfield systems are exposed to various levels of shocks and vibration during transportation and operations. For example, drill stem testing (DST) electronics are typically installed and tested at a field location and then transported on a truck or flown to a rig. A DST string can then be conveyed inside the well in high pressure, high temperature (HPHT) environments for weeks at a time. Surviving the transportation and operations is a key requirement for DST equipment, including the associated DST electronics.

SUMMARY

A summary of certain embodiments described herein is set forth below. It should be understood that these aspects are presented merely to provide the reader with a brief summary of these certain embodiments and that these aspects are not intended to limit the scope of this disclosure.

In a first embodiment, a shock damping ring for use in a downhole tool includes a base ring structure a plurality of fingers extending from the base ring structure axially parallel to a central axis of the base ring structure. Each finger of the plurality of fingers is configured to physically abut first and second tubular components of a downhole tool and to reduce shock amplification between the first and second tubular components of the downhole tool. In addition, at least one finger of the plurality of fingers includes a beveled, chamfered, or radiused surface configured to physically abut one tubular component of the first and second tubular components of the downhole tool, and an orthogonal surface configured to physically abut the other tubular component of the first and second tubular components of the downhole tool. The shock damping ring may also include one or more grooves configured to facilitate passage of other components of the downhole tool (e.g., wires, tubing, and structural elements) between the first and second tubular components of the downhole tool.

In another embodiment, a downhole tool includes first and second tubular components, and a shock damping ring. The shock damping ring includes a base ring structure and a plurality of fingers extending from the base ring structure axially parallel to a central axis of the base ring structure. Each finger of the plurality of fingers is configured to physically abut the first and second tubular components and to reduce shock amplification between the first and second tubular components. In addition, at least one finger of the plurality of fingers includes a beveled, chamfered, or radiused surface configured to physically abut one tubular component of the first and second tubular components, and an orthogonal surface configured to physically abut the other tubular component of the first and second tubular components. The shock damping ring may also include one or more grooves configured to facilitate passage of other components (e.g., wires, tubing, and structural elements) between the first and second tubular components.

In a further embodiment, a shock damping ring for use in a downhole tool includes a base ring structure and three fingers extending from the base ring structure axially parallel to a central axis of the base ring structure. Each finger of the three fingers is configured to physically abut first and second tubular components of a downhole tool and to reduce shock amplification between the first and second tubular components of the downhole tool. In addition, each finger of the three fingers includes a beveled, chamfered, or radiused surface disposed on an outer wall of the respective finger and configured to physically abut one tubular component of the first and second tubular components of the downhole tool, and an orthogonal surface disposed on an inner wall of the respective finger and configured to physically abut the other tubular component of the first and second tubular components of the downhole tool. The shock damping ring may also include a plurality of grooves configured to facilitate passage of other components of the downhole tool (e.g., wires, tubing, and structural elements) between the first and second tubular components of the downhole tool. The plurality of grooves may include grooves in respective inner walls of the three fingers, grooves in respective outer walls of the three fingers, and one or more grooves on an outer surface of the base ring structure. The shock damping ring may further include one or more anti-rotation features (e.g., keys).

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended to familiarize the reader with certain aspects and contexts of embodiments of the present disclosure without limitation to the claimed subject matter.

BRIEF DESCRIPTION OF THE DRAWINGS

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
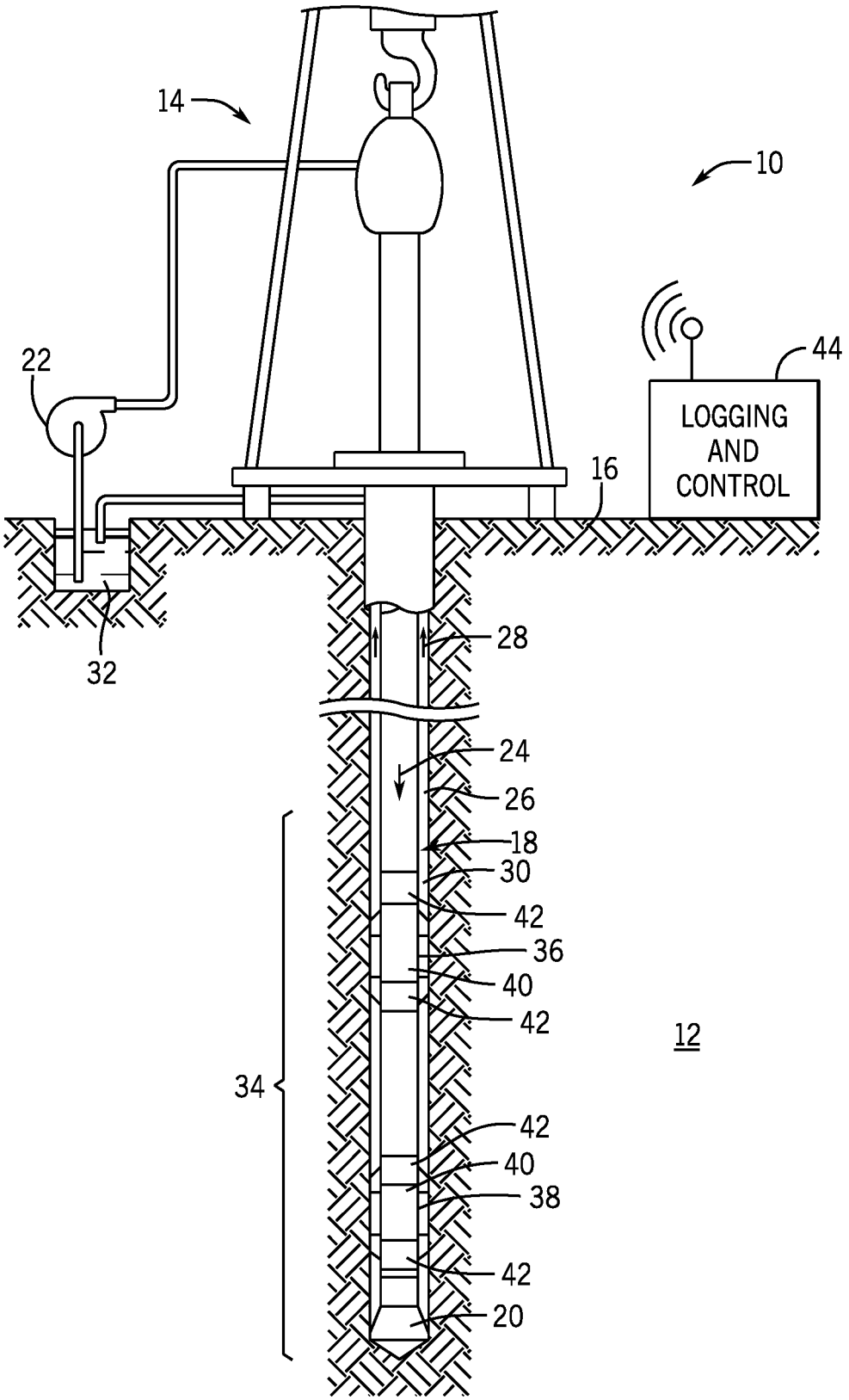
FIG. 1 is a partial cross sectional view of a drilling system used to drill a well through subsurface formations, in accordance with an embodiment of the present techniques.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In downhole testing systems (e.g., DST), typical electronics that are conveyed downhole may include solenoid driver boards, controller boards, multichip modules (MCMs), in-line capacitors, pressure transducers, and so forth. The electronic systems in DST operations control functionality such as receiving pressure pulses or electric signals and sending commands, for example, to open and close specific valves multiple times while running in the hole. Electronic systems are now commonly adopted and form a must-have requirement for performing DST well tests.

Conveying complex electronic systems downhole represents a design challenge. Electronic components are typically housed inside DST string components, tubular designs such as mandrels, housings, subs threaded together to build a DST string. Electronics are mounted in between several internal sections that require clearances to pass other components (e.g., wires, tubing, and structural elements) and fit internal components, which can leave certain sections susceptible to relatively high shock amplification due to different components vibrating at different frequencies.

The embodiments described herein reduce shock level on the electronics inside downhole tools that are used for reservoir testing or other oilfield applications. In particular, the shock damping ring described herein serves the purpose of truncating a long and free-to-move mandrel upon which the electronics are sitting into smaller zones, which reduces the length of the mandrel exposed to vibration and shock. The shock damping ring fills between the mandrel and the housing of the downhole tool tightly so that a smaller isolated zone is being created on the mandrel. A shorter section of the mandrel will experience less accelerations and noise under the same amount of shock and protect a previously vulnerable electronics section from damaging shock values.

Variations of this design may be retrofitted in existing tubular designs such as various downhole testing systems. For example, the embodiments described herein allow upgrading of electronics on downhole testing systems, which may be required for certain temperature ratings and to ensure business continuity for such critical assets. In addition, the embodiments described herein enable the installation of certain electronics, such as modems, to enable direct communication with wireless telemetry systems. Without the shock damping ring described herein, the shock amplification might damage such modems. Currently, for downhole testing systems to connect to wireless telemetry systems, they must rely on modems installed on adjacent equipment in the string. Being able to independently interface with wireless telemetry systems reduces the number of downhole tools needed and the overall length of DST string, leading to cost savings and greater job design flexibility.

FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a "mud" pump 22 is used to pump drilling fluid, commonly referred to as "mud" or "drilling mud," downward through the center of the drill string 18 in the direction of the arrow 24 to the drill bit 20. The mud, which is used to cool and lubricate the drill bit 20, exits the drill string 18 through ports (not shown) in the drill bit 20. The mud then carries drill cuttings away from the bottom of a borehole 26 as it flows back to the surface 16, as shown by the arrows 28 through an annulus 30 between the drill string 18 and the formation 12. At the surface 16, the return mud is filtered and conveyed back to a mud pit 32 for reuse.

While a drill string 18 is illustrated in FIG. 1, it will be understood that the embodiments described herein are applicable to work strings and wireline tools as well. Work strings may include a length of tubing (e.g. coil tubing) lowered into the well for conveying well treatments or well servicing equipment. Wireline tools may include formation testing tools suspended from a multi-wire cable as the cable is lowered into a well so that it can measure formation properties at desired depths. It should be noted that the location and environment of the well may vary widely depending on the formation 12 into which it is drilled. Instead of being a surface operation, for example, the well may be formed under water of varying depths, such as on an ocean bottom surface. Certain components of the drilling system 10 may be specially adapted for underwater wells in such instances.

As illustrated in FIG. 1, the lower end of the drill string 18 includes a bottom-hole assembly ("BHA") 34 that includes the drill bit 20, as well as a plurality of drill collars 36, 38. The drill collars 36, 38 may include various instruments, such as sample-while-drilling ("SWD") tools that include sensors, telemetry equipment, and so forth. For example, the drill collars 36, 38 may include logging-while-drilling ("LWD") modules 40 and/or measurement-while drilling ("MWD") modules 42. The LWD modules or tools 40 may include tools configured to measure formation parameters or properties, such as resistivity, porosity, permeability, sonic velocity, and so forth. The MWD modules or tools 42 may include tools configured to measure borehole trajectory, borehole temperature, borehole pressure, and so forth. The LWD modules 40 of FIG. 1 are each housed in one of the drill collars 36, 38, and each contain any number of logging tools and/or fluid sampling devices. The LWD modules 40 include capabilities for measuring, processing and/or storing information, as well as for communicating with the MWD modules 42 and/or directly with the surface equipment such as, for example, a logging and control computer 44.

In certain embodiments, the LWD modules 40 may pump formation fluid and other fluids from a high pressure environment (e.g., borehole 26) to a lower pressure environment (e.g., formation 12). Such operations may include, for example, sampling from and re-injecting formation fluids into the formation 12, sampling formation fluids and injecting chemicals into the formation 12, injecting tracers into the formation 12, providing enhanced oil recovery analysis, and providing flowback control.

Figure 2:
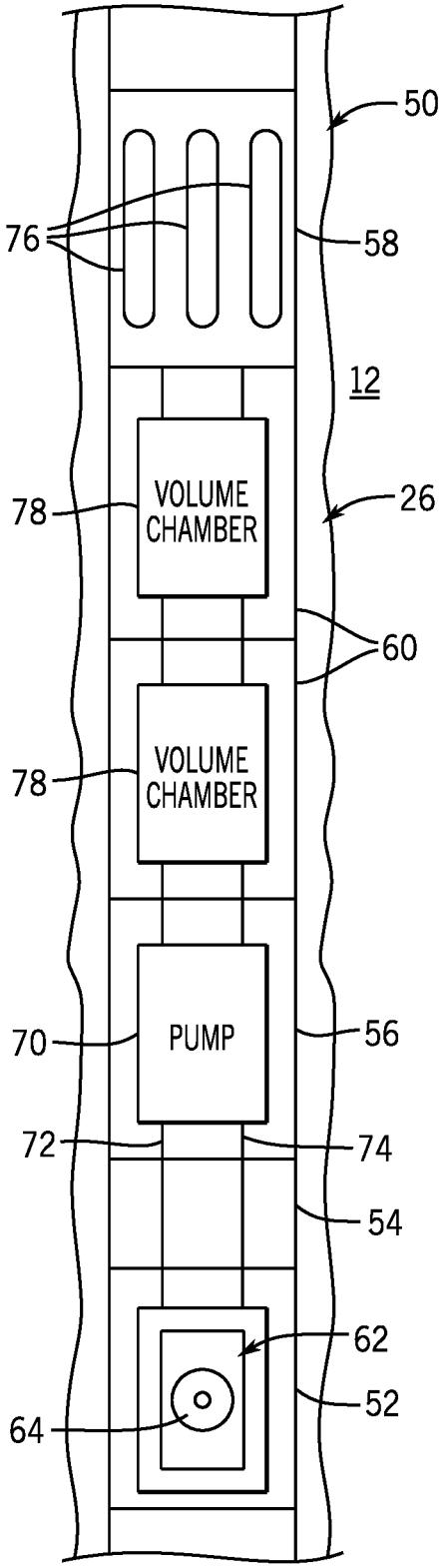
FIG. 2 is a schematic diagram of downhole equipment having pump modules used to sample fluid from subsurface formations, in accordance with an embodiment of the present techniques.

FIG. 2 is a schematic diagram of an embodiment of downhole equipment (equipment configured for operation downhole) used to sample a well formation, to inject fluid into a well formation, or both. Specifically, the illustrated downhole equipment includes an embodiment of a downhole fluid sampling tool 50, hereinafter referred to as a downhole tool 50. The downhole tool 50 is illustrated as being disposed within the borehole 26 of the subsurface formation 12 in order to sample formation fluid from the formation 12, to inject fluid into the formation 12, or both. In certain embodiments, the downhole tool 50 may be disposed in the borehole 26 via a wireline. That is, the downhole tool 50 may be suspended in the borehole 26 from a lower end of the wireline, which may be a multi-conductor cable spooled from a winch. The wireline may be electrically coupled to surface equipment, in order to communicate various control signals and logging information between the downhole tool 50 and the surface equipment. It should be noted that in other embodiments, such as shown in FIG. 1, the downhole tool 50 may include one or more of the SWD tools (e.g., LWD modules 40), which are disposed in the borehole 26 via the drill string 18. In still other embodiments, the downhole tool 50 may include DST tools, which are testing tools that form the BHA 34 (without a drill bit 20) of a string of tubular lowered from the drilling rig 14 into the borehole 26.

The illustrated downhole tool 50 includes a probe module 52, a hydraulics module 54 a pump module 56, a multi-sample module 58, and two volume chamber modules 60. It should be noted that other arrangements of the modules that make up the downhole tool 50 may be possible. For example, in certain embodiments, there may be several multi-sample modules 58, or certain components of the pump module 56 and the hydraulics module 54 may be combined. Moreover, the components shown within each of the illustrated modules may be arranged differently in other embodiments of the downhole tool 50. In addition, these components of the downhole tool 50 may be arranged differently depending on the type of fluid sampling, injection, or flowback control applications to be carried out by the downhole tool 50.

The illustrated probe module 52 may include an extendable fluid communication line (e.g., probe 62) designed to engage the formation 12 and to communicate formation fluid from the formation 12 into the downhole tool 50. In certain embodiments, the probe 62 may include a fluid inlet 64 into the probe 62, and the formation fluid may be pumped into the downhole tool 50 through this fluid inlet 64. Thus, the probe 62 may function as an inlet for the formation fluid pumped into the downhole tool 50, as well as an outlet for fluids being injected into the formation 12.

In addition to the probe 62, the probe module 52 may include two or more setting mechanisms (not shown). Setting mechanisms may be configured to extend outward from the probe module 52 and to engage the borehole 26 in an opposite direction from the extendable probe 62. The setting mechanisms may include pistons in some embodiments, although other types of probe modules 52 may utilize a different type of probe 62 and/or setting mechanism.

In certain embodiments, the probe module 52 may utilize a different type of probe 62 than the one illustrated in FIG. 2. For example, the probe module 52 may include one or more packer elements configured to be inflated into contact with an inner wall of the borehole 26. In this manner, the packer elements may function as setting mechanisms for keeping the downhole tool 50 in place and for isolating a section of the borehole 26 around the probe 62. It should be noted that the presently disclosed techniques of pumping fluid from a high pressure to a lower pressure while downhole may utilize any number of probes 62 and/or packers. Additionally, the arrangement, configuration, size, or shape of these probes 62 and/or packers may vary across different embodiments.

In certain embodiments, the hydraulics module 54 may include, among other things, electronics, batteries, sensors, and/or hydraulic components used to operate the probe 62 and any corresponding setting mechanisms within the probe module 52. The pump module 56 may include a pump 70 used to create a pressure differential that draws the formation fluid in through the probe 62 and pushes the fluid through one of two flowlines 72 and 74 of the downhole tool 50. The pump 70 may include an electromechanical pump used for pumping formation fluid from the probe module 52 to the multi-sample modules 58 and/or out of the downhole tool 50. In an embodiment, the pump 70 operates as a piston displacement unit (DU) driven by a ball screw coupled to a gearbox and an electric motor, although other types of pumps 70 may be used in other embodiments. Power may be supplied to the pump 70 via other components located in the pump module 56, via components located in the hydraulics module 54, or via a separate power generation module (not shown). During a sampling process, the pump 70 moves the formation fluid through one of the flowlines (e.g., 72), toward the one or more multi-sample modules 58 or the volume chamber modules 60.

The multi-sample modules 58 may each include one or more sample bottles 76 for collecting samples of the formation fluid being pumped through the downhole tool 50. Based on characteristics of the formation fluid detected via sensors (e.g., spectrometer, pressure sensors, temperature sensors, etc.) along one or both of the flowlines 72 and 74, the downhole tool 50 may be operated in a sample collection mode or a continuous pumping mode. When operated in the sample collection mode, valves disposed at or near entrances of the sample bottles 76 may be positioned to allow the formation fluid to flow into the sample bottles 76. The sample bottles 76 may be filled one at a time, and once a sample bottle 76 is filled, its corresponding valve may be moved to another position to seal the sample bottle 76. When the valves are closed, the downhole tool 50 may operate in a continuous pumping mode.

In a continuous pumping mode, the pump 70 moves the formation fluid into the downhole tool 50 through the probe 62, through one or both of the flowlines 72 and 74, and out of the downhole tool 50 through a flowline exit port (not shown). The flowline exit port may be a check valve that releases the formation fluid into the borehole 26, or it may be a valve which performs a similar function but is operated by commands sent from equipment at the surface. The downhole tool 50 may operate in the continuous pumping mode until the formation fluid flowing through the flowline 72 is determined to be clean enough for sampling. This is because when the formation fluid is first sampled, residual drilling mud filtrate may enter the downhole tool 50 along with the sampled formation fluid. After pumping the formation fluid for an amount of time, the formation fluid flowing through the downhole tool 50 may provide a more pure sample of the uncontaminated formation fluid than would otherwise be available when first drawing fluid in through the probe 62.

In addition to the modules described above, present embodiments of the downhole tool 50 include one or more volume chamber modules 60. These volume chamber modules 60 each include a bulk volume chamber 78 configured to receive, store, and release relatively large volumes of fluids. There are two sides of each volume chamber 78 that can hold separate types of fluid, and each side may be configured to receive fluid from or transmit fluid to the first flowline 72, the second flowline 74, a port leading to the borehole 26, or some combination thereof. This makes the volume chamber 78 relatively versatile for use in directing fluid flow through the two flowlines 72 and 74 in the downhole tool 50.

As discussed in detail below, the downhole tool 50 may be arranged such that the pump 70 pumps fluids into and out of the different sides of the volume chambers 78, in order to generate a depressurized environment or a pressurized environment in one of the flowlines 72 and 74. This enables the pump 70 to then pump formation fluid, or some other fluid, through the downhole tool 50 across a desirable pressure differential. As a result, the downhole tool 50 may be able to pump relatively large volumes of fluid from a high pressure environment to a low pressure environment, in addition to performing other operations.

Figure 3:
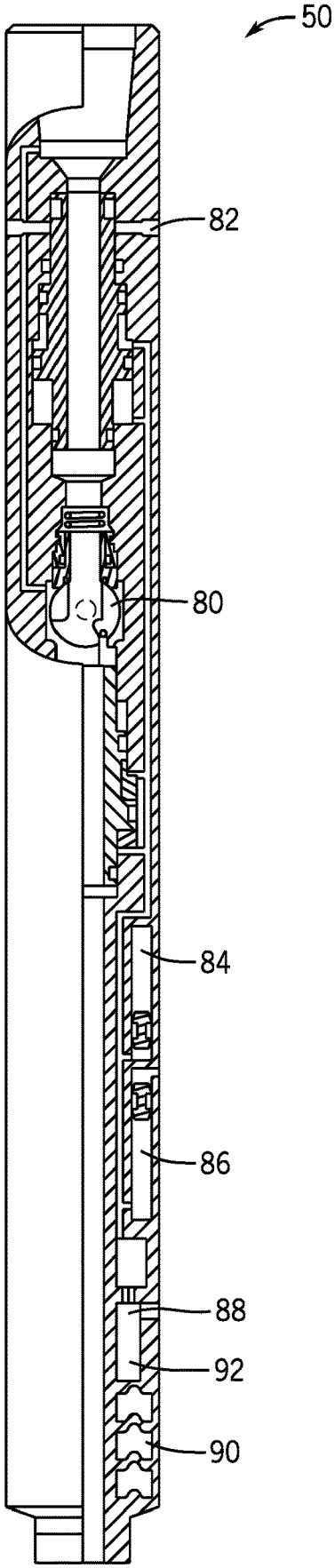
FIG. 3 illustrates a downhole tool having dual valves for controlling the flow of fluids through the downhole tool, in accordance with an embodiment of the present techniques.

FIG. 3 illustrates another embodiments of the downhole tool 50 having dual valves for controlling the flow of fluids through the downhole tool 50. For example, the downhole tool 50 may have a main test valve 80 and a circulating valve 82 that can be cycled independently or sequentially for increased flexibility. In addition, in certain embodiments, the downhole tool 50 may include an atmospheric chamber 84 and a hydrostatic chamber 86 for storing the sample fluids. In addition, in certain embodiments, the downhole tool 50 may include various sensors 88, batteries 90, and other electronics 92.

Figure 4:
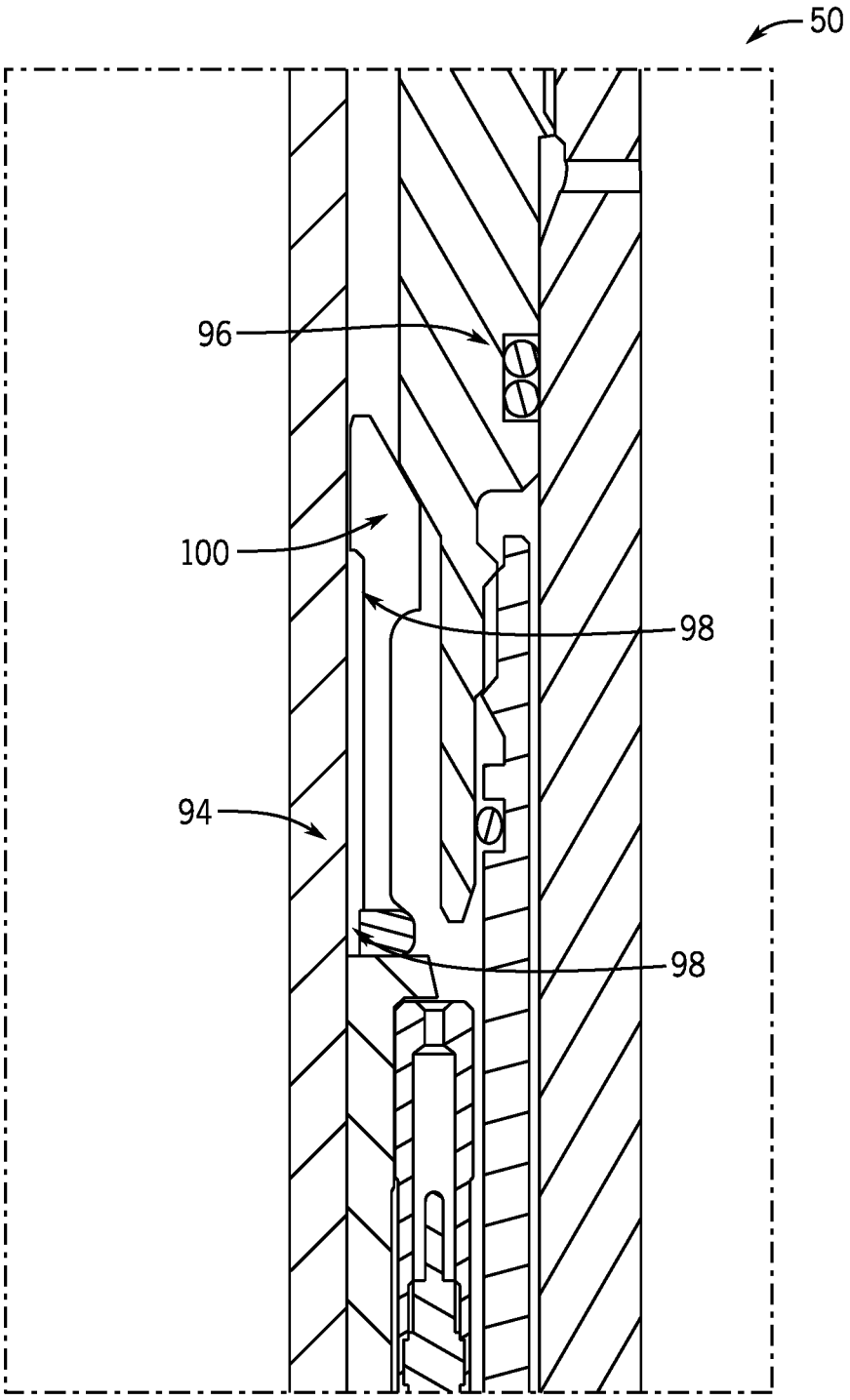
FIG. 4 is a cross-section view of a downhole tool having a shock damping ring disposed radially between a mandrel upon which electronics are mounted and a housing, in accordance with an embodiment of the present techniques.
Figure 5:
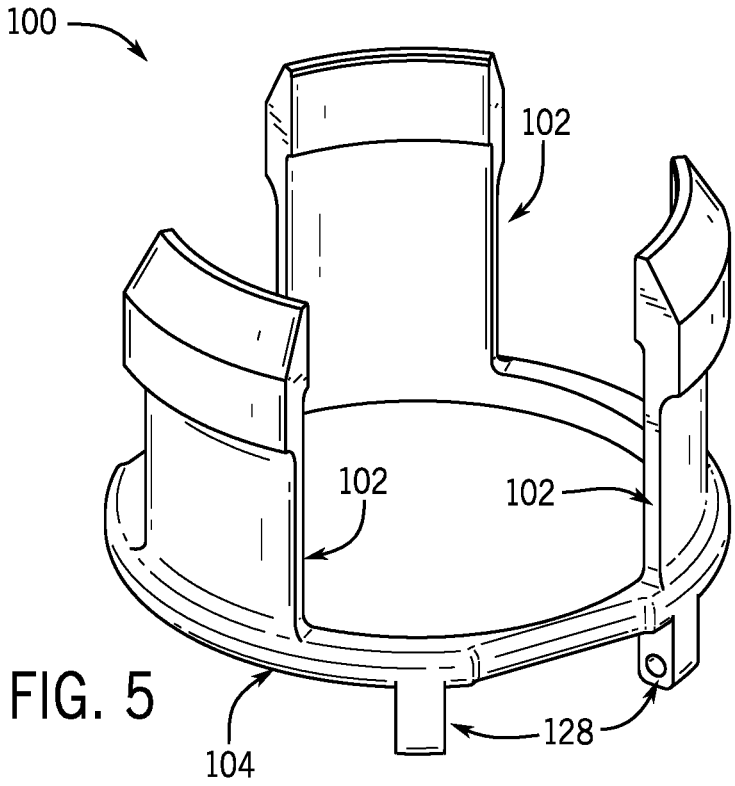
FIG. 5 is a front-left-top perspective view of an embodiment of the shock damping ring illustrated in FIG. 4, in accordance with an embodiment of the present techniques.
Figure 6:
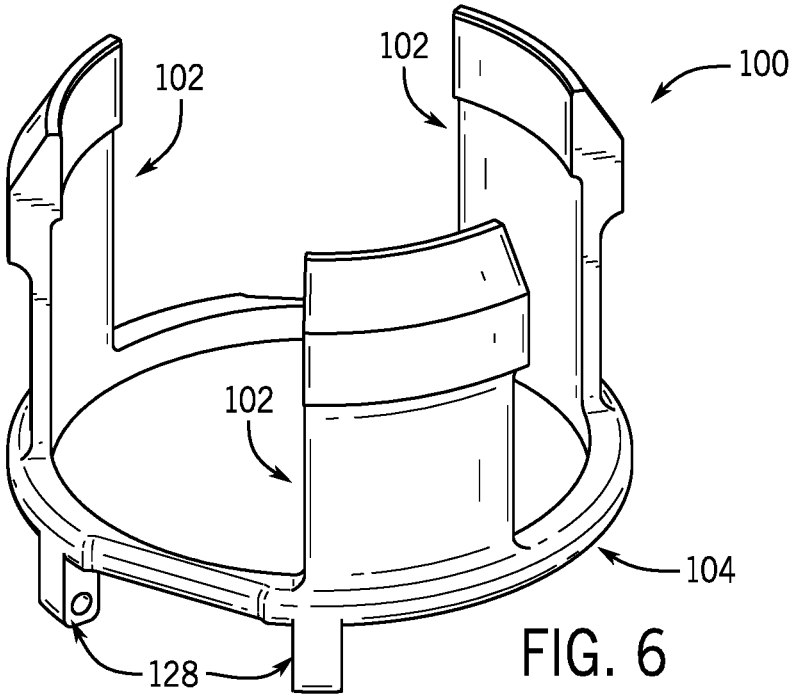
FIG. 6 is a front-right-top perspective view of an embodiment of the shock damping ring illustrated in FIG. 4, in accordance with an embodiment of the present techniques.
Figure 7:
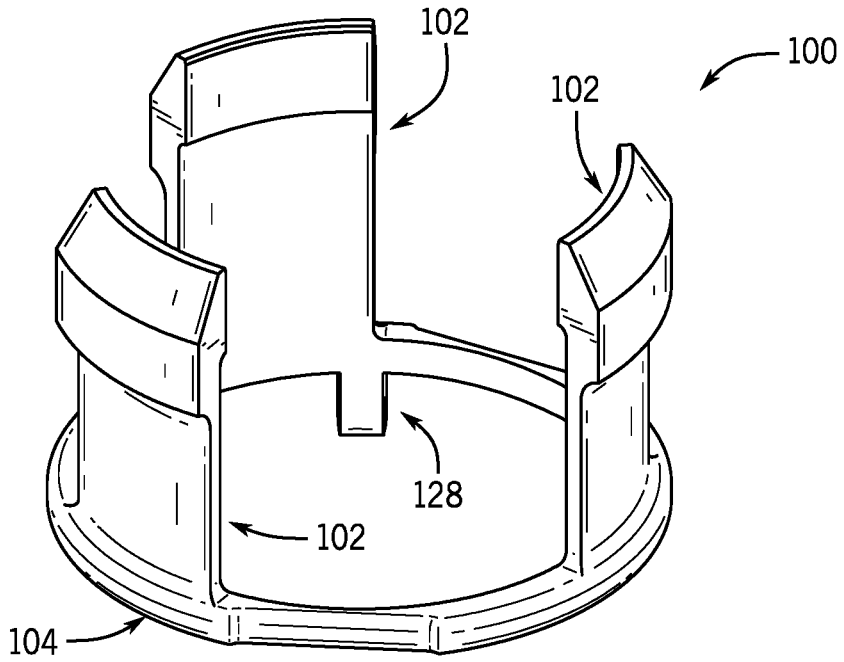
FIG. 7 is a rear-left-top perspective view of an embodiment of the shock damping ring illustrated in FIG. 4, in accordance with an embodiment of the present techniques.
Figure 8:
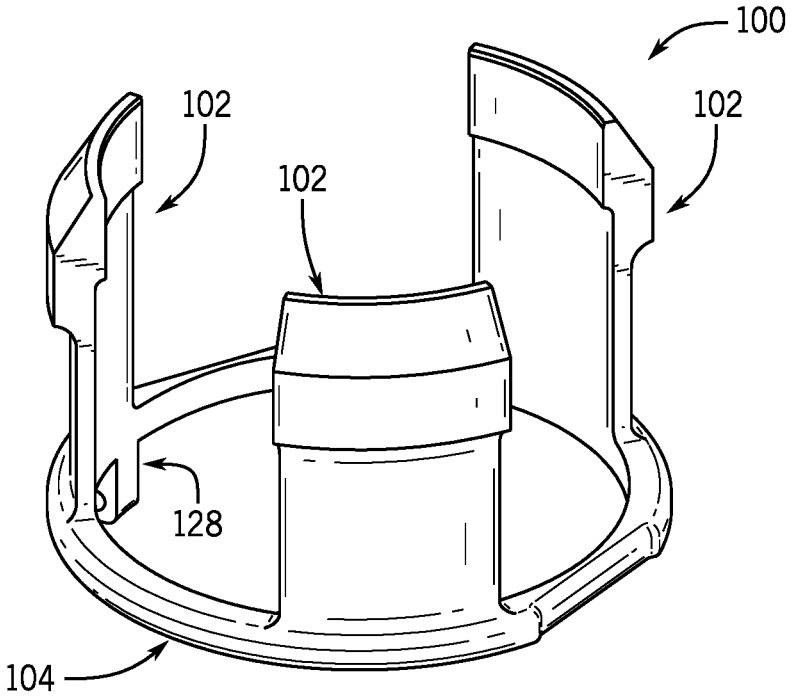
FIG. 8 is a rear-right-top perspective view of an embodiment of the shock damping ring illustrated in FIG. 4, in accordance with an embodiment of the present techniques.
Figure 9:
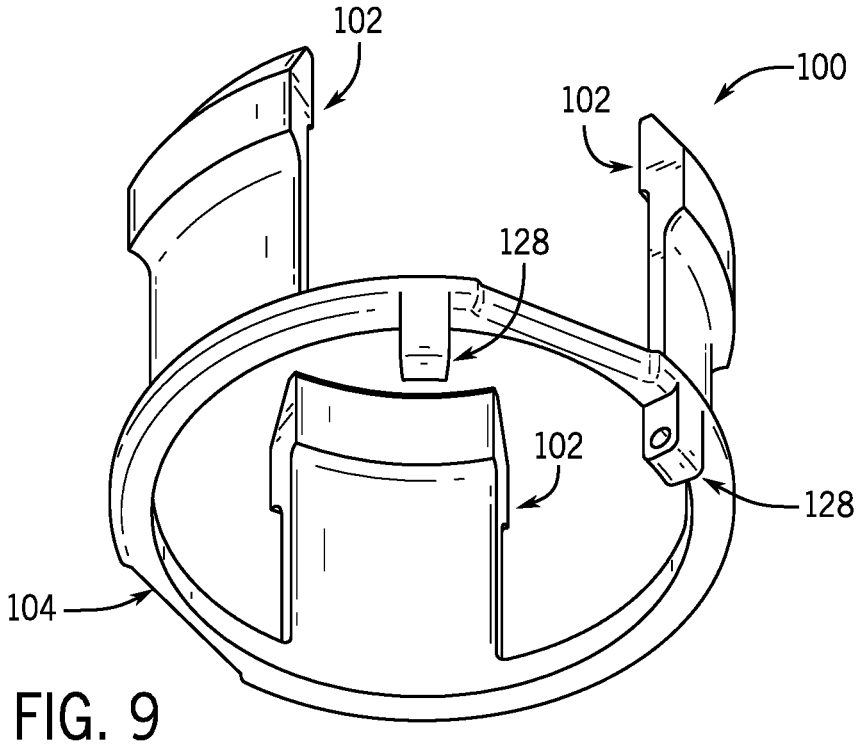
FIG. 9 is a front-left-bottom perspective view of an embodiment of the shock damping ring illustrated in FIG. 4, in accordance with an embodiment of the present techniques.
Figure 10:
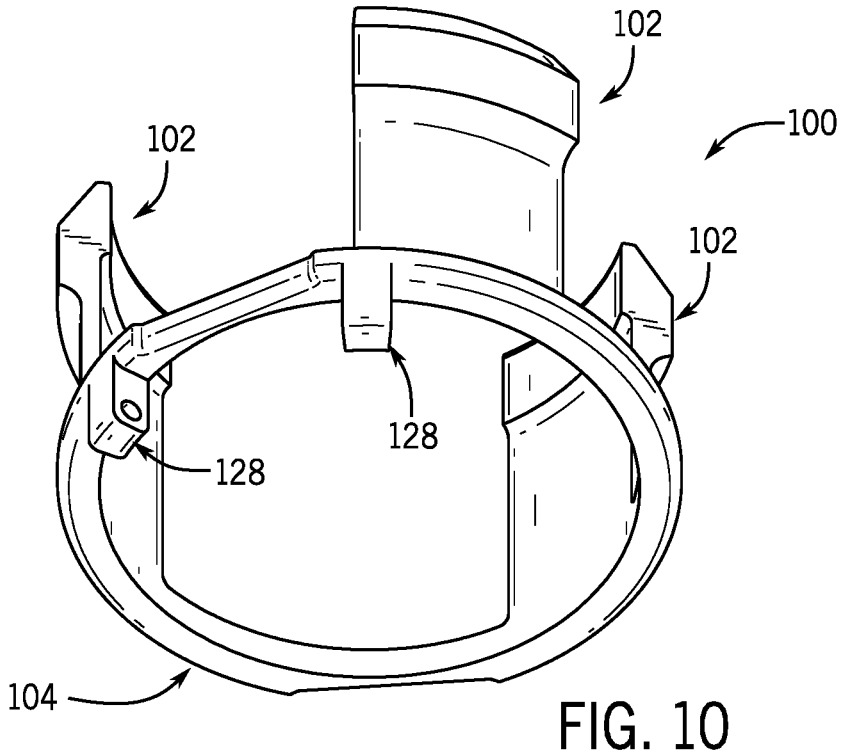
FIG. 10 is a front-right-bottom perspective view of an embodiment of the shock damping ring illustrated in FIG. 4, in accordance with an embodiment of the present techniques.
Figure 11:
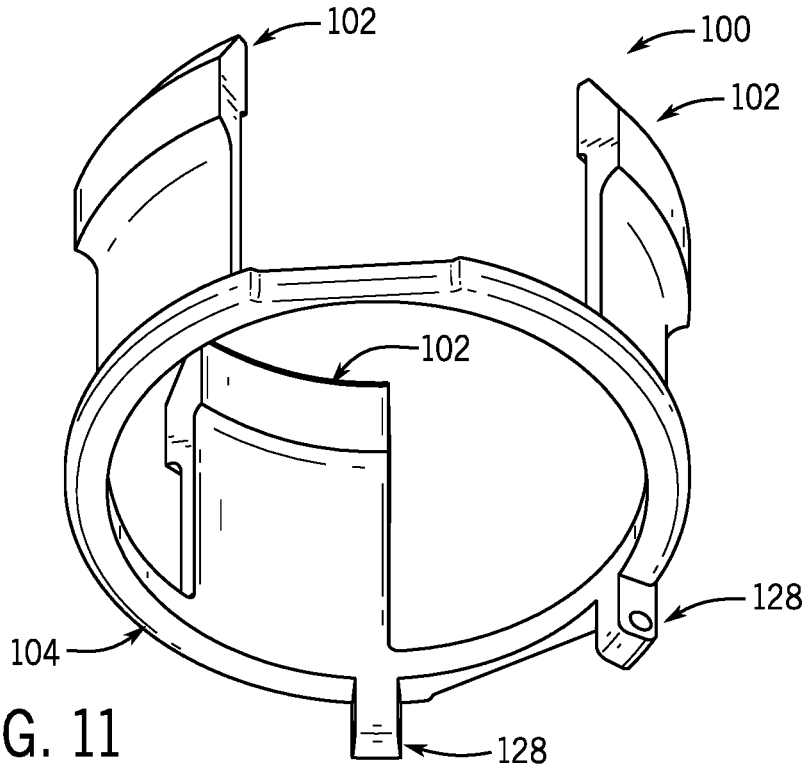
FIG. 11 is a rear-left-bottom perspective view of an embodiment of the shock damping ring illustrated in FIG. 4, in accordance with an embodiment of the present techniques.
Figure 12:
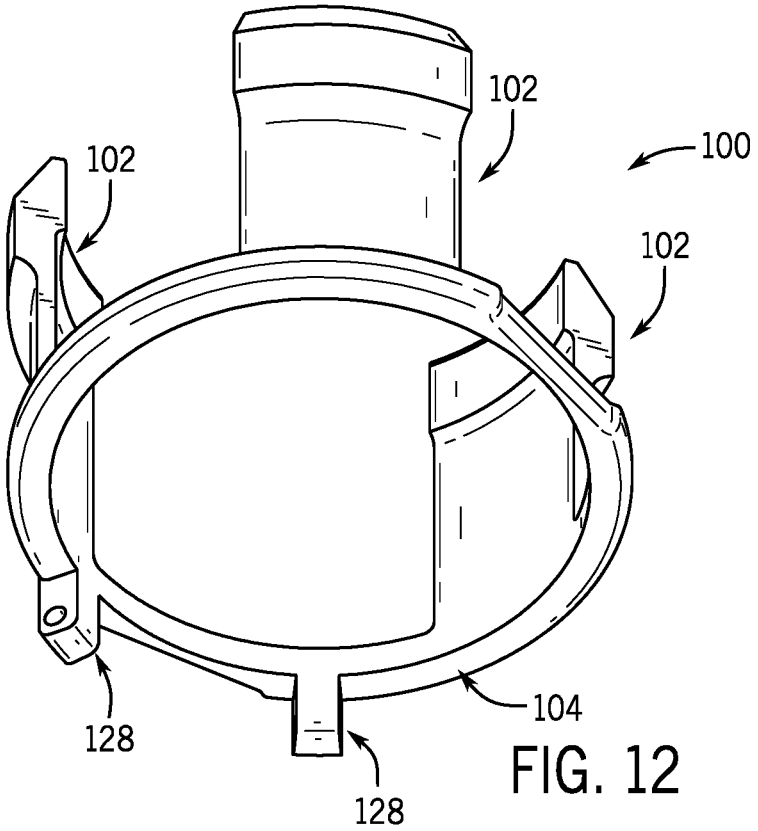
FIG. 12 is a rear-right-bottom perspective view of an embodiment of the shock damping ring illustrated in FIG. 4, in accordance with an embodiment of the present techniques.
Figure 13:
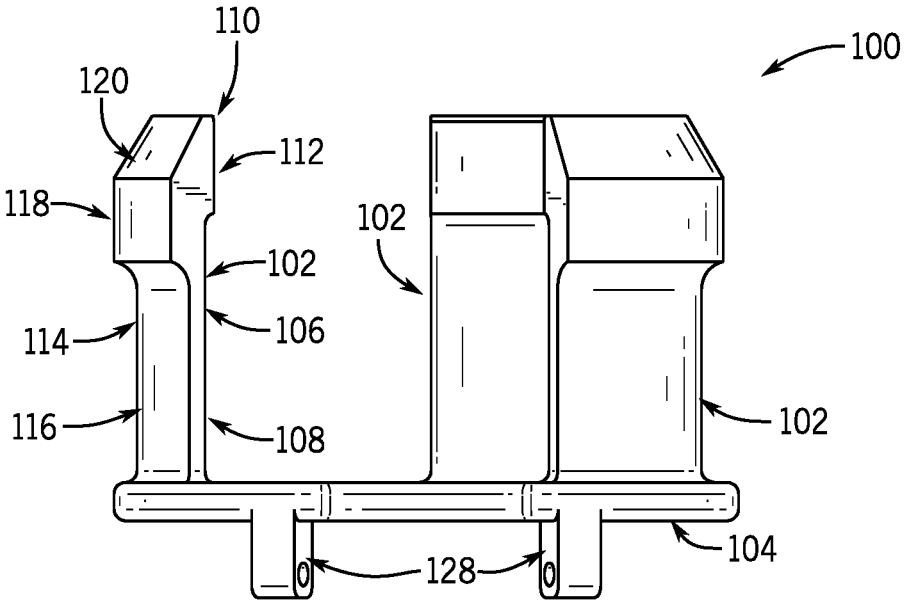
FIG. 13 is a front view of an embodiment of the shock damping ring illustrated in FIG. 4, in accordance with an embodiment of the present techniques.

As illustrated in FIG. 4, in certain embodiments, components of the downhole tool 50, including the electronics 92, may be housed inside tubular string components such as mandrels 94, housings 96, and subs threaded together to build a DST string. In particular, the electronics 92 may be mounted in between several internal sections that require clearances 98 to pass other components of the downhole tool 50 (e.g., wires, tubing, and structural elements) and fit internal components, as described in greater detail herein, which can leave certain sections susceptible to relatively high shock amplification due to different components vibrating at different frequencies.

As described in greater detail herein, a shock damping ring 100 may be configured to reduce shock level on the electronics 92 inside the downhole tool 50. In particular, the shock damping ring 100 described herein serves the purpose of truncating a long and free-to-move mandrel 94 upon which the electronics 92 are sitting into smaller zones, which reduces the length of the mandrel 94 exposed to vibration and shock. The shock damping ring 100 fills between the mandrel 94 and the housing 96 of the downhole tool 50 tightly so that a smaller isolated zone is being created on the mandrel 94. A shorter section of the mandrel 94 will experience less accelerations and noise under the same amount of shock and protect a previously vulnerable electronics section from damaging shock values. As described in greater detail herein, the particular design of the shock damping ring 100 may be scaled and configured to meet a variety of internal geometries.

FIGS. 5-18 illustrate various views of an embodiment of the shock damping ring 100 illustrated in FIG. 4. These figures illustrate various key features that enable the shock damping ring 100 to reduce the shock amplification among internal tubular components (e.g., mandrels 94, housings 96, and so forth), thereby reducing the risk of shock damage to electronics 92 inside a downhole tool 50 with which the shock damping ring 100 directly interacts.

For example, as illustrated in the figures, the shock damping ring 100 may include a plurality of fingers 102 that extend axially from a base ring structure 104 of the shock damping ring 100 in the same axial direction. In the embodiment illustrated in FIGS. 5-18, the shock damping ring 100 includes three fingers 102. However, in other embodiments, the shock damping ring 100 may include other numbers of fingers 102, such as two, four, five, six, and so forth. In general, the fingers 102 of the shock damping ring 100 carry the installation load between radially adjacent tubular components (e.g., the mandrel 94 and the housing 96 illustrated in FIG. 4).

In addition, as best illustrated in FIGS. 13-16, each of the fingers 102 may include inner walls 106 configured to physically interact with inner tubular components (e.g., the mandrel 94 illustrated in FIG. 4). In addition, in certain embodiments, the inner walls 106 of the fingers 102 may include grooves 108 cutout from the base ring structure 104 to a head portion 110 of the respective finger 102, which includes a relatively orthogonal surface 112 configured to abut the respective inner tubular component (e.g., the mandrel 94 illustrated in FIG. 4).

Similarly, each of the fingers 102 may include outer walls 114 configured to physically interact with outer tubular components (e.g., the housing 96 illustrated in FIG. 4). In addition, in certain embodiments, the outer walls 114 of the fingers 102 may include grooves 116 cutout from the base ring structure 104 to the head portion 110 of the respective finger 102, which includes a relatively orthogonal section 118 configured to abut the respective outer tubular component (e.g., the housing 96 illustrated in FIG. 4). In addition, in certain embodiments, each finger 102 may include a beveled surface 120 that facilitates the shock damping ring 100 carrying the installation load between radially adjacent tubular components (e.g., the mandrel 94 and the housing 96 illustrated in FIG. 4). Although illustrated in the drawings as including beveled surfaces 120, in other embodiments, the surfaces 120 may instead be chamfered (e.g., a symmetrical sloping edge), radiused (e.g., having a rounded or otherwise curved edge), and so forth. In addition, although illustrated in the drawings as each including beveled, chamfered, or radiused surfaces 120, in other embodiments, only at least one of the fingers 102 (e.g., one finger 102, two fingers 102, or any number of fingers 102) may include a beveled, chamfered, or radiused surface 120.

Figure 17:
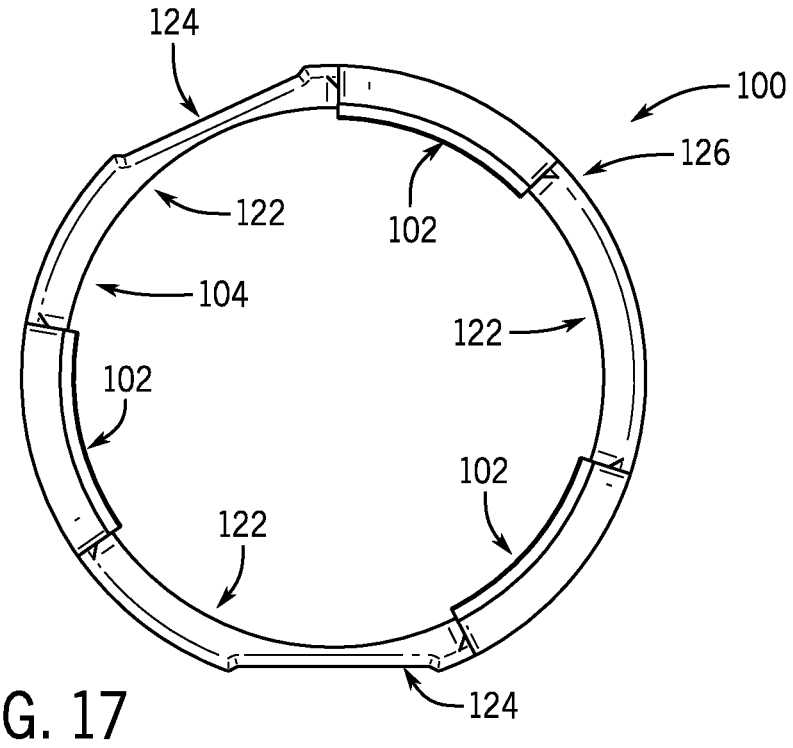
FIG. 17 is a top view of an embodiment of the shock damping ring illustrated in FIG. 4, in accordance with an embodiment of the present techniques.
Figure 18:
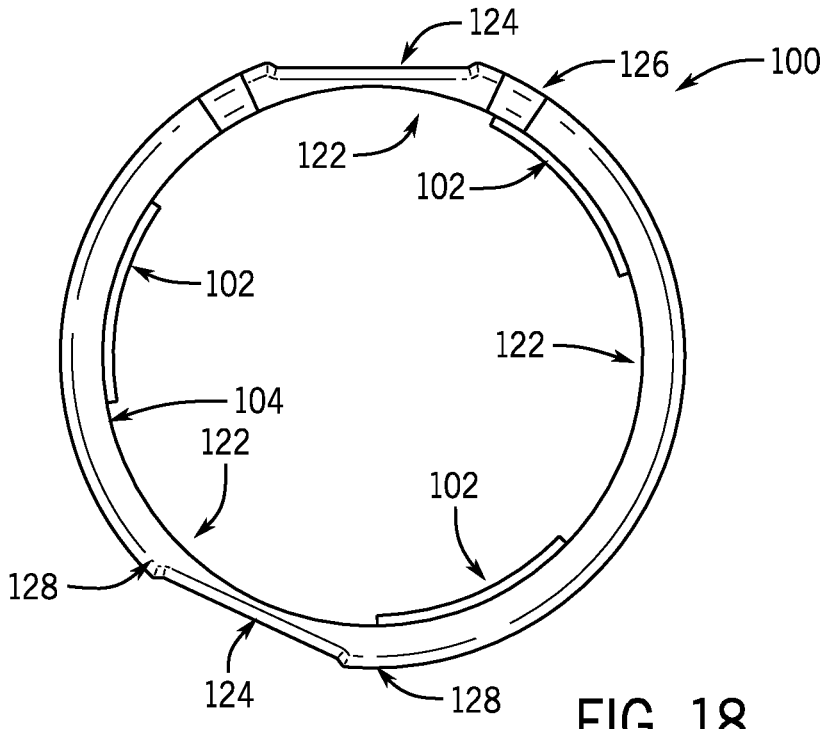
FIG. 18 is a bottom view of an embodiment of the shock damping ring illustrated in FIG. 4, in accordance with an embodiment of the present techniques.

In addition, as best illustrated in FIGS. 17 and 18, the circumferential space 122 between fingers 102 provides sufficient space for passing and storage of wiring between different downhole tool components. In addition, in certain embodiments, the base ring structure 104 of the shock damping ring 100 may include one or more cutout spaces (e.g., grooves) 124 on an outer surface 126 of the base ring structure 104 to provide additional space for passing and storage of wiring between different downhole tool components. It is noted that, in certain embodiments, the fingers 102 (and associated circumferential space 122 between fingers 102) as well as the cutout spaces (e.g., grooves) 124 of the base ring structure 104 may be circumferentially distributed unevenly around the base ring structure 104. However, in other embodiments, the fingers 102 (and associated circumferential space 122 between fingers 102) as well as the cutout spaces (e.g., grooves) 124 of the base ring structure 104 may be circumferentially distributed relatively evenly around the base ring structure 104.

Figure 14:
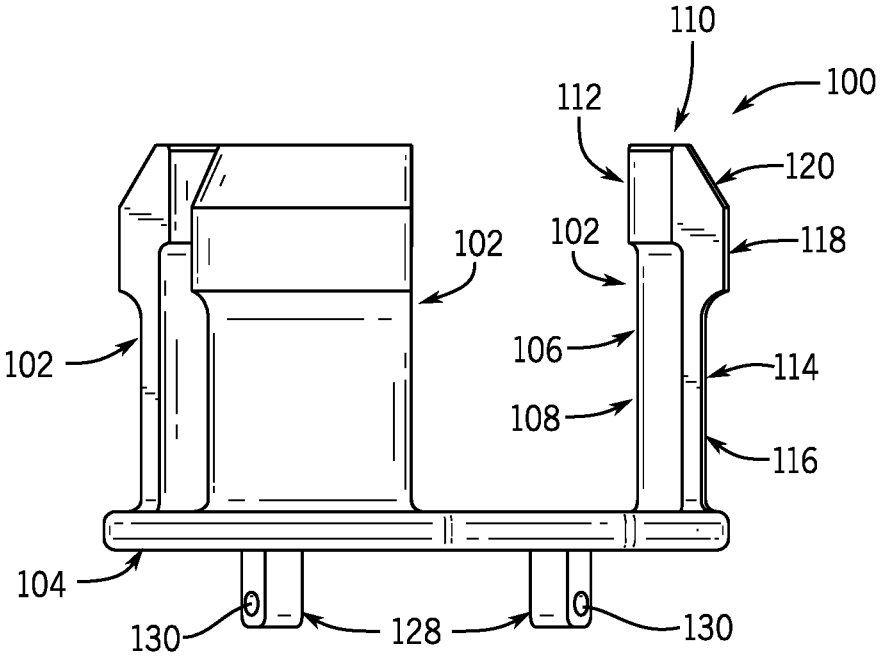
FIG. 14 is a rear view of an embodiment of the shock damping ring illustrated in FIG. 4, in accordance with an embodiment of the present techniques.
Figure 15:
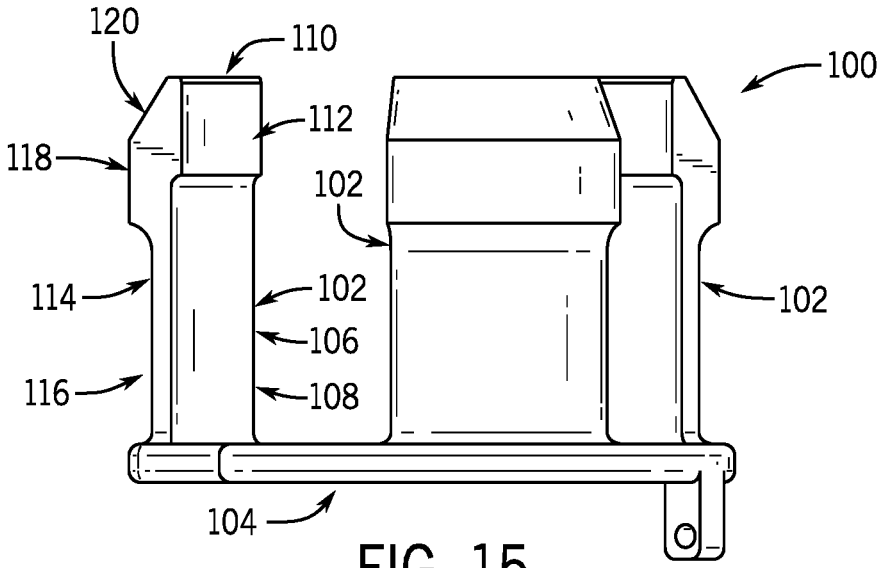
FIG. 15 is a left side view of an embodiment of the shock damping ring illustrated in FIG. 4, in accordance with an embodiment of the present techniques.
Figure 16:
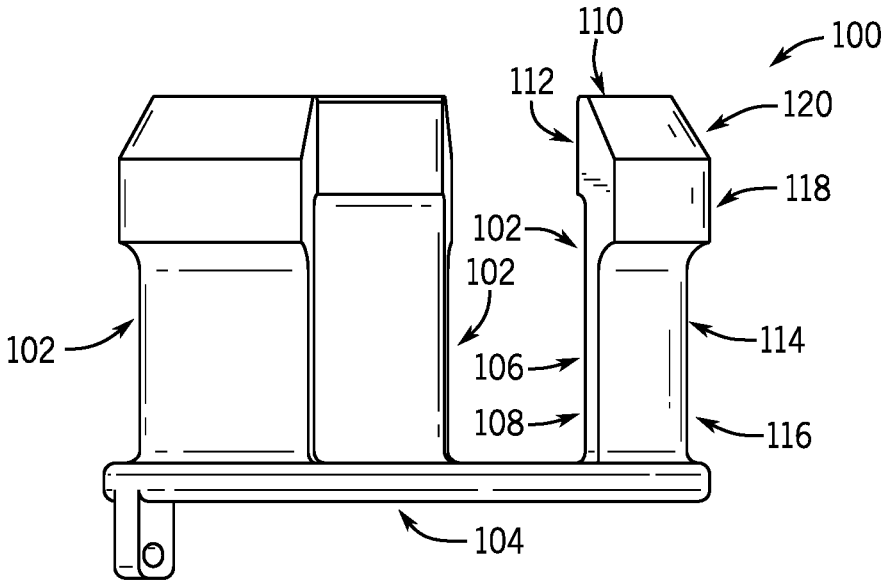
FIG. 16 is a right side view of an embodiment of the shock damping ring illustrated in FIG. 4, in accordance with an embodiment of the present techniques.

In addition, the shock damping ring 100 may include one or more anti-rotation keys 128 (or other type of anti-rotation feature(s) that extend axially from the base ring structure 104 on an opposite axial side of the base ring structure 104 from the fingers 102. As best illustrated in FIG. 14, in certain embodiments, at least some of the one or more anti-rotation keys 128 may include pin holes 130 for receiving anti-rotation pins. In general, the one or more anti-rotation keys 128 block inadvertent rotation during installation, which might otherwise potentially damage wires and mating components.

Figure 19:
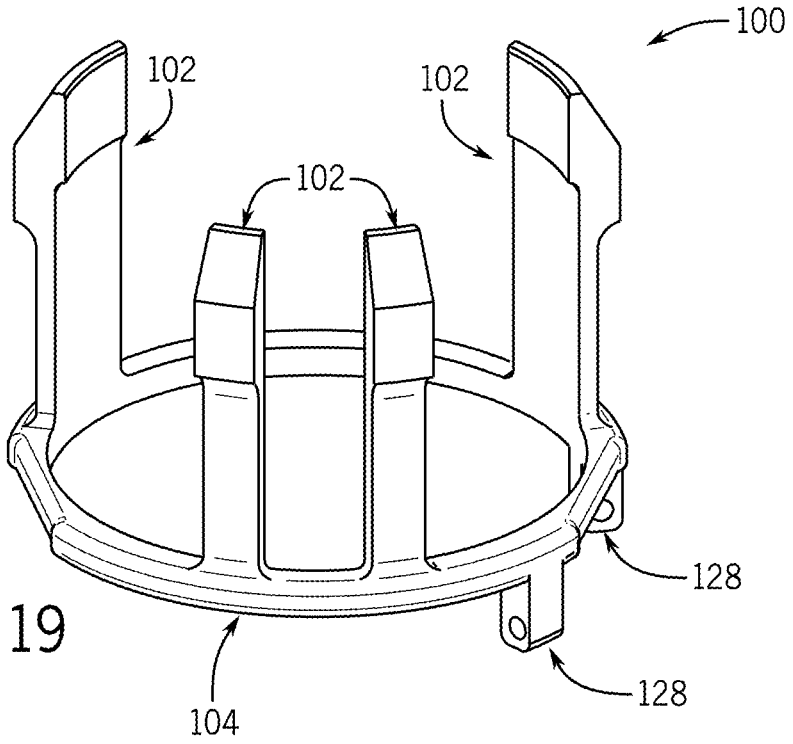
FIG. 19 illustrates a first alternative embodiment of the shock damping ring illustrated in FIGS. 5-18, in accordance with an embodiment of the present techniques.
Figure 20:
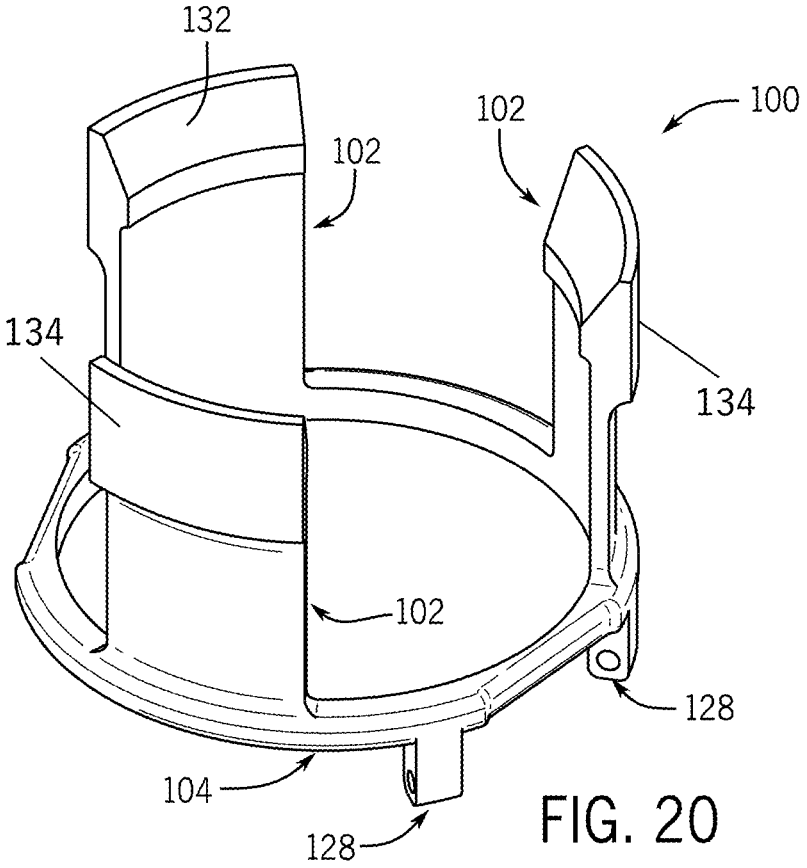
FIG. 20 illustrates a second alternative embodiment of the shock damping ring illustrated in FIGS. 5-18, in accordance with an embodiment of the present techniques.

The embodiment illustrated in FIGS. 5-18 is but one example of an embodiment of a shock damping ring 100. Other alternative embodiments of the shock damping ring 100 may include other geometries and applications. For example, FIG. 19 illustrates an alternative embodiment of the shock damping ring 100 that includes four fingers 102 instead of the three fingers 102 illustrated in FIGS. 5-18. In addition, FIG. 20 illustrates an alternative embodiment of the shock damping ring 100 that includes fingers 102 having a beveled surface 132 on the outer wall 114 of the respective finger 102 (e.g., as opposed to on the inner wall 106 of the respective finger 102) configured to abut the respective inner tubular component (e.g., the mandrel 94 illustrated in FIG. 4), and a relatively orthogonal surface 134 configured to abut the respective outer tubular component (e.g., the housing 96 illustrated in FIG. 4). As such, this alternative configuration of the shock damping ring 100 is configured to be clamped to the respective outer tubular component (e.g., the housing 96 illustrated in FIG. 4) instead of the respective inner tubular component (e.g., the mandrel 94 illustrated in FIG. 4), as is the embodiment illustrated in FIGS. 5-18. As described above, although illustrated in the drawings as including beveled surfaces 132, in other embodiments, the surfaces 132 may instead be chamfered (e.g., a symmetrical sloping edge), radiused (e.g., having a rounded or otherwise curved edge), and so forth. In addition, although illustrated in the drawings as each including beveled, chamfered, or radiused surfaces 132, in other embodiments, only at least one of the fingers 102 (e.g., one finger 102, two fingers 102, or any number of fingers 102) may include a beveled, chamfered, or radiused surface 132.

While the present disclosure may be susceptible to various modifications and alternative forms, specific embodiments have been shown by way of example in the drawings and have been described in detail herein. However, it should be understood that the present disclosure is not intended to be limited to the particular forms disclosed. For example, while some embodiments described herein contain specific combinations of coring systems, other combinations may also be possible. Rather, the present disclosure is intended to cover all modifications, equivalents, and alternatives falling within the spirit and scope of the present disclosure as defined by the following appended claims. In particular, it will be appreciated that any and all combinations and sub-combinations of the various features described herein may be included or omitted from any particular embodiment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A shock damping ring for use in a downhole tool comprising:
- a base ring structure;
- a plurality of fingers extending from the base ring structure axially parallel to a central axis of the base ring structure, wherein each finger of the plurality of fingers is configured to physically abut first and second tubular components of a downhole tool and to reduce shock amplification between the first and second tubular components of the downhole tool, and wherein at least one finger of the plurality of fingers comprises:
  - a beveled, chamfered, or radiused surface configured to physically abut one tubular component of the first and second tubular components of the downhole tool; and
  - an orthogonal surface configured to physically abut the other tubular component of the first and second tubular components of the downhole tool;
- one or more grooves; and
- one or more anti-rotation keys extending axially from the base ring structure on an opposite axial side of the base ring structure from the plurality of fingers.

2. The shock damping ring of claim 1, wherein the one or more grooves comprise grooves in respective inner walls of the plurality of fingers.

3. The shock damping ring of claim 1, wherein the one or more grooves comprise grooves in respective outer walls of the plurality of fingers.

4. The shock damping ring of claim 1, wherein the one or more grooves comprise one or more grooves on an outer surface of the base ring structure.

5. The shock damping ring of claim 1, wherein the shock damping ring comprises three fingers extending from the base ring structure axially parallel to the central axis of the base ring structure.

6. The shock damping ring of claim 1, wherein the shock damping ring comprises four fingers extending from the base ring structure axially parallel to the central axis of the base ring structure.

7. The shock damping ring of claim 1, wherein each finger of the plurality of fingers comprise the beveled, chamfered, or radiused surface disposed on a respective outer wall, and the orthogonal surface disposed on a respective inner wall.

8. The shock damping ring of claim 1, wherein each finger of the plurality of fingers comprise the beveled, chamfered, or radiused surface disposed on a respective inner wall, and the orthogonal surface disposed on a respective outer wall.

9. The shock damping ring of claim 1, wherein the plurality of fingers are circumferentially distributed unevenly around the base ring structure.

10. The shock damping ring of claim 1, wherein the plurality of fingers are circumferentially distributed evenly around the base ring structure.

11. A downhole tool, comprising:
- first and second tubular components; and
- a shock damping ring, comprising:
  - a base ring structure;
  - a plurality of fingers extending from the base ring structure axially parallel to a central axis of the base ring structure, wherein each finger of the plurality of fingers is configured to physically abut the first and second tubular components and to reduce shock amplification between the first and second tubular components, and wherein at least one finger of the plurality of fingers comprises:
    - a beveled, chamfered, or radiused surface configured to physically abut one tubular component of the first and second tubular components; and
    - an orthogonal surface configured to physically abut the other tubular component of the first and second tubular components;
  - one or more grooves; and
  - one or more anti-rotation keys extending axially from the base ring structure on an opposite axial side of the base ring structure from the plurality of fingers.

12. The downhole tool of claim 11, wherein the one or more grooves comprise grooves in respective inner walls of the plurality of fingers.

13. The downhole tool of claim 11, wherein the one or more grooves comprise grooves in respective outer walls of the plurality of fingers.

14. The downhole tool of claim 11, wherein the one or more grooves comprise one or more grooves on an outer surface of the base ring structure.

15. The downhole tool of claim 11, wherein the shock damping ring comprises three fingers extending from the base ring structure axially parallel to the central axis of the base ring structure.

16. The downhole tool of claim 11, wherein the shock damping ring comprises four fingers extending from the base ring structure axially parallel to the central axis of the base ring structure.

17. A shock damping ring for use in a downhole tool comprising:
- a base ring structure;
- three fingers extending from the base ring structure axially parallel to a central axis of the base ring structure, wherein each finger of the three fingers is configured to physically abut first and second tubular components of a downhole tool and to reduce shock amplification between the first and second tubular components of the downhole tool, and wherein each finger of the three fingers comprises:

a beveled, chamfered, or radiused surface disposed on an outer wall of the respective finger and configured to physically abut one tubular component of the first and second tubular components of the downhole tool; and an orthogonal surface disposed on an inner wall of the respective finger and configured to physically abut the other tubular component of the first and second tubular components of the downhole tool;

a plurality of grooves comprising grooves in respective inner walls of the three fingers, grooves in respective outer walls of the three fingers, and one or more grooves on an outer surface of the base ring structure; and one or more anti-rotation keys extending axially from the base ring structure on an opposite axial side of the base ring structure from the three fingers.

18. The shock damping ring of claim 17, wherein the three fingers are circumferentially distributed unevenly around the base ring structure.

* * * * *